United States Patent [19]

Harada et al.

[11] Patent Number: 4,547,979

[45] Date of Patent: Oct. 22, 1985

[54] ATHLETIC SHOE SOLE

[75] Inventors: Masasuke Harada; Yoshiharu Moronaga, both of Kurume, Japan

[73] Assignee: Nippon Rubber Co., Ltd., Tokyo, Japan

[21] Appl. No.: 622,144

[22] Filed: Jun. 19, 1984

[30] Foreign Application Priority Data

Jun. 20, 1983 [JP] Japan ..... 58-111583

[51] Int. Cl.[4] ..... A43B 13/12; A43B 13/14; A43B 13/04; A43B 13/26

[52] U.S. Cl. ..... 36/30 R; 36/31; 36/32 R; 36/59 C; 36/114

[58] Field of Search ..... 36/59 R, 59 C, 59 B, 36/67 R, 67 A, 32 R, 30 R, 31 R, 114, 129; D2/320

[56] References Cited

U.S. PATENT DOCUMENTS

| | | | |
|---|---|---|---|
| 4,255,874 | 3/1981 | Sironi | 36/59 C |
| 4,307,521 | 12/1981 | Inohara | 36/59 C |
| 4,364,189 | 12/1982 | Bates | 36/30 R |
| 4,399,620 | 8/1983 | Funck | 36/30 R |

FOREIGN PATENT DOCUMENTS

| | | | |
|---|---|---|---|
| 0096819 | 6/1983 | European Pat. Off. | 36/129 |
| 54-127750 | 10/1979 | Japan | 36/32 R |
| 58-49101 | 3/1983 | Japan . | |

*Primary Examiner*—James Kee Chi

*Attorney, Agent, or Firm*—Fleit, Jacobson, Cohn & Price

[57] ABSTRACT

An athletic shoe sole constructed to provide good cushioning and durability and to preclude overpronation of the foot. An outersole body progressively increases in thickness toward the inside edge of the sole from a longitudinal midline axis of thereof in a region extending from a heel portion to an arch portion of the outersole body, and is provided with a plurality of projection harder than the outersole body secured to its lower surface on an inner side of a heel portion of the outersole body and a plurality of projections softer than the outersole body secured to its lower surface on the remaining region of the outersole body. A cushioning midsole has a shape in section complementary to the thickness of the outersole body is overlaid on it.

1 Claim, 4 Drawing Figures

ATHLETIC SHOE SOLE

BACKGROUND OF THE INVENTION

This invention relates to athletic shoes and more particularly, has for its purpose the provision of such athletic shoes which avoid any overpronation of the foot during running, are comfortable to mear and have good durability.

The human anatomy is such that when a person runs, at each step the rear portion of the heel of the foot makes initial contact with the ground, followed by the heel proper, the outside edge of the foot adjacent to the arch, the ball of the little toe and the ball of the big toe in that order, and finally the big, second, third, fourth and little toe effect the toe-off motion. This motion of the foot is accompanied by a shift of the person's body weight thereon. It has been known that the foot excessively rolls inward, that is to say, overpronates depending upon the cushioning of a midsole of a shoe in the course of the initially contacting motion of the heel to the subsequent contacting motion of the foot. Such overpronation causes, trouble with the knee joint.

Japanese Patent Public Disclosure 58-49101 discloses an athletic shoe sole adapted to preclude overpronation wherein a midsole has hard cylindrical stabilizers embedded in the inside portion of the heel. The hard cylindrical stabilizers reduce shock absorption in the heel inside portion of the midsole to result in uncomfortable shoes. A combination of good cushioning of the middle and hardness of the stabilizers also results in damage to the midsole at the interfaces therebetween the reduce the durability of the shoes.

SUMMARY OF THE INVENTION

It is a general object of the present invention to provide athletic shoes which overcome the disadvantages of the prior art.

It is a further object of the invention to provide such athletic shoes each having a sole which exhibits good cushioning and impact absorption in the heel while precluding overpronation of the foot during running.

These and other objects and advantages of the present invention will become apparent from the following detailed description when considered in connection with the accompanying drawing wherein.

DETAILED DESCRIPTION OF THE INVENTION

Figure 1:
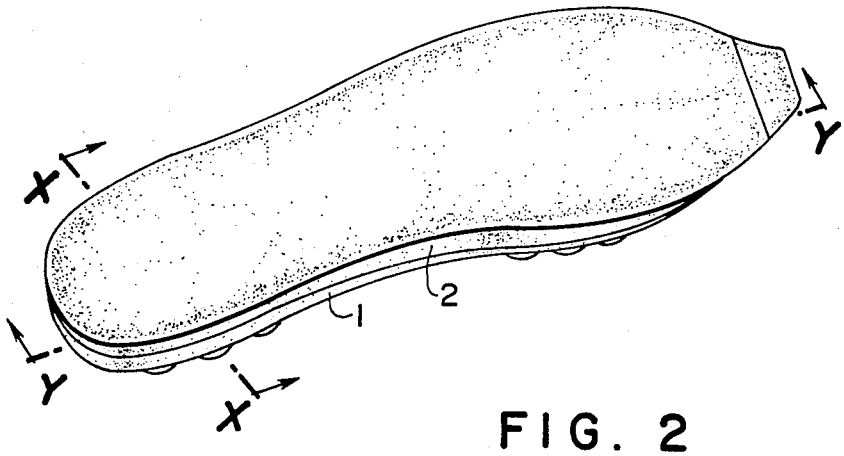
FIG. 1 is a perspective view of an athletic shoe sole constructed in accordance with the present invention.
Figure 2:
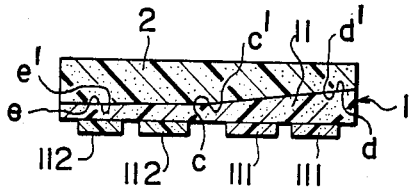
FIG. 2 is a sectional view of the sole taken along line X—X of FIG. 1.
Figure 3:
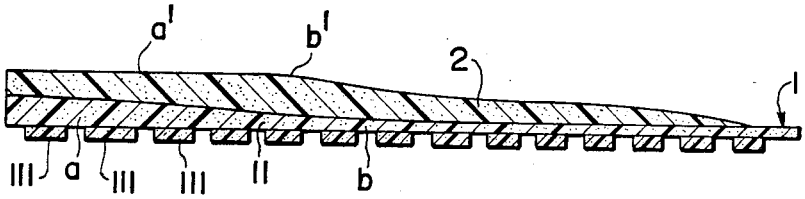
FIG. 3 is a sectional view of the sole taken along line Y—Y of FIG. 1.
Figure 4:
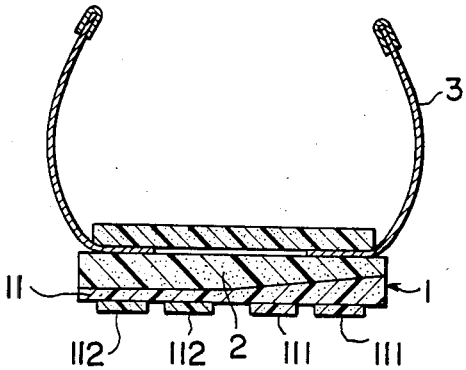
FIG. 4 is a sectional view of an athletic shoe having the sole constructed in accordance with the present invention.

Referring to FIGS. 1 through 3 of the drawing, there is shown an athletic shoe sole comprising an outersole 1 and a cushioning midsole 2 overlaid on the outersole 1. The outersole 1 includes an outersole body 11 pregressively increasing in thickness toward the inside edge of the sole on an inner side d of a longitudinal midline axis c of the outersole body and in a longitudinal region extending from a heel portion a to an arch portion b of the outersole body 11. The outersole body 11 is provided with a plurality of projections 111 secured to the lower surface thereof on the inner side of the heel portion and a plurality of projections 112 secured to the lower surface of the outersole body in its remaining region. The projections 111 is harder than that of the outersole body 11 whereas the projection 112 is softer than that of the outersole body 11. The cushioning midsole 2 progressively decreases toward the inside edge of the sole on an inner side d' of a longitudinal midline axis c' of the midsole 2 and in a region extending from a heel portion a' to an arch portion b' of the midsole 2 complementary to the thickness of the outersole body. Alternatively, the outersole body may progressively increase in thickness laterally inwardly from the outside edge to the inside edge thereof, while the cushioning midsole may have a complemental shape in section.

The outerall outside 1 including the outersole body 11 and projections 111 and 112 is preferably formed from a solid material, but may be formed from an expanded material. Alternatively, the outersole body 11 may be formed from the expanded material whereas the projections 111 and 112 may be formed from the solid material. In the case where the whole outersole 1 is of solid material, the outersole body 11 preferably has JIS hardness of 50°–70° (hardness test in accordance with JIS K6301) and the projections 111 and 112 have preferably JIS hardness of 60°–80° and JIS hardness 40°–60°, respectively. The outersole body 11 may progressively decrease in thickness longitudinally toward the arch portion b from the heel portion a on the inner side d of the outerside body 11 to achieve good bonding between the outersole body 11 and the cushioning midsole 2.

The cushioning midsole 2 may be of either a single layer or multiple layers of an expanded material having sponge hardness of 50°–70° (hardness test in accordance with SRIS (The Society of Rubber Industry, Japan Standard) 0101). In the case of the multiple layers of the expanded material, they may have different sponge hardnesses.

FIG. 3 illustrates an athletic shoe constructed by mormting the sole according to the present invention on an upper 3 in a conventional manner. In manufacture of the shoe, the cushioning midsole 2 is injection molded between the preformed outersole 1 and the upper 3 to bond them to each other.

When a person runs with the athletic shoes on his feet, a combination of the projections 112 softer than the outersole body 11 and the thicker portion of the midsole 2 on the outer side e' than on the inner side a' exhibits good cushioning and shock absorption during initial contact of the heel of the sole with the ground. A combination of the hard projections 111, the portion of the outersole body 11 progressively increasing in thickness on the inner side d and the portion of the cushioning midsole 2 progressively decreasing in thickness on the inner side d' of the longitudinal midline axis c' results in a laterally inwardly progressively reducing cushioning on the inner side of the heel of the sole to prevent the foot from excessively rolling inward when the heel makes contact with the ground on the medical side of the longitudinal midline axis thereof. Since the harder projections 111 are bonded to the portion of the outersole body 11 which progressively increases in thickness on the inner side d, the thicker portion of the outersole body 11 can effectively absorb impact shock on the harder projections from the ground. This not only prevents the cushioning midsole 2 from being released from the outersole 1 at the interface therebetween, but also avoids any damage to the midsole 2 by the harder projections.

It will be noted from the foregoing that the present invention provides the comfortable athletic shoes which preclude overpronation and have good durability.

What is claimed is:

1. An athletic shoe sole comprising an outersole including an outersole body progressively increasing in thickness toward the inside edge of the sole at least on an inner side of a longitudinal midline axis of a heel portion of the outersole body, a plurality of projections harder than the outersole body secured to the lower surface of the heel portion on the inner side and a plurality of projections softer than the outersole body secured to the remaining area of the outersole body, and a cushioning midsole overlaid on said outersole body and progressively decreasing in thickness toward the inside edge of the sole on an inner side of a longitudinal midline axis of a heel portion of the midsole complementary to the thickness of the outersole body.

* * * * *